United States Patent [19]

Godlewski et al.

[11] 4,056,294

[45] Nov. 1, 1977

[54] OPEN ARM SEWING MACHINE CABINET

[75] Inventors: Walter A. Godlewski, Maywood; Bernard S. Roser, Arlington Heights; John B. Lyons, Chicago, all of Ill.

[73] Assignee: Montgomery Ward & Co., Incorporated, Chicago, Ill.

[21] Appl. No.: 725,401

[22] Filed: Sept. 22, 1976

[51] Int. Cl.[2] ..... D05B 75/00; A47B 57/20

[52] U.S. Cl. ..... 312/30; 312/21; 112/217.1

[58] Field of Search ..... 312/20, 21, 27-30; 112/217.1, 258, 260

[56] References Cited

U.S. PATENT DOCUMENTS

| | | | |
|---|---|---|---|
| 3,051,538 | 8/1962 | Parsons | 312/30 |
| 3,806,217 | 4/1974 | Current | 312/30 |
| 3,823,993 | 7/1974 | Kakishima | 312/21 |
| 3,946,682 | 3/1976 | Cowdrey et al. | 312/21 |

*Primary Examiner*—Casmir A. Nunberg
*Attorney, Agent, or Firm*—Carpenter & Ostis

[57] ABSTRACT

A cabinet for storage of a sewing machine operable selectively for open arm and flat bed sewing is disclosed. The machine is mounted fast to a first panel for swinging movement therewith to operative position, and is locked in place by a second panel which swings out of position during the swinging movement of the first panel and to a return position to hold the first panel with the machine mounted thereon into a position for open arm sewing. Additional panels are mounted for swinging movement away from the machine during open arm operation thereof, and towards the machine to lie in planar relationship for flat bed sewing.

8 Claims, 17 Drawing Figures

OPEN ARM SEWING MACHINE CABINET

BACKGROUND OF THE INVENTION

1. Field of the Invention

The structure according to the present invention is especially adapted for use with modern sewing machines capable of both open arm and flat bed sewing. The structure is characterized by a simple arrangement for supporting the machine for both kinds of sewing with the machine in either kind of sewing position being surrounded by the panels to define a plane for convenience of the operator.

2. The Prior Art

Developed in a search appears to be best exemplified in the following patents:

| | | |
|---|---|---|
| Parsons | U.S. Pat. No. 3,051,538 | Class 312/30 |
| Williams | U.S. Pat. No. 3,765,739 | Class 312/30 |
| Kakishima | U.S. Pat. No. 3,823,993 | Class 312/21 |
| Roberts et al | U.S. Pat. No. Re. 28,835 | Class 312/20 |

Parsons achieves locking of a machine for open arm sewing by hinging the support panel to a locking panel having edges captured in notches within the cabinet.

Williams employs a special locking shelf cooperating with a spring biased locking arm disposed on the panel supporting the machine.

Kakishima has a special ramp for movement of the panel supporting the machine.

Roberts et al effects storage movement of the machine by means of a remotely controlled lever, a construction made unnecessary by this invention structure.

SUMMARY OF THE INVENTION

The structure according to the present invention makes it possible to store a sewing machine and to raise the same to operating position for either open arm or flat bed operation all without the need for involved mechanism and remotely operated control devices. In position for either kind of sewing the machine is surrounded by panels presenting coplanar surfaces for convenience of the opertor.

THE DRAWINGS

Figure 1:
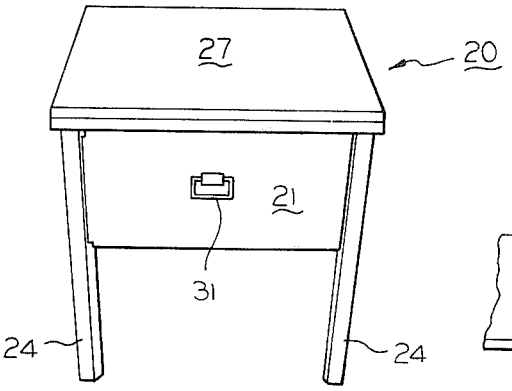
FIG. 1 is a prspective view of a sewing machine cabinet embodying the improvements according to the present invention.
Figure 2:
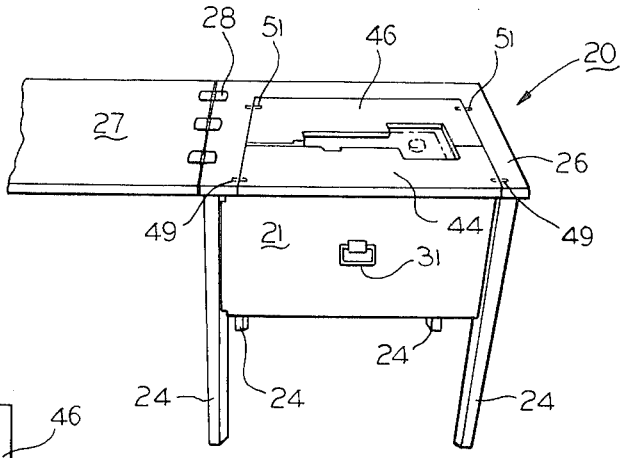
FIG. 2 is a similar view showing the closure panel thereof in open position.
Figure 3:
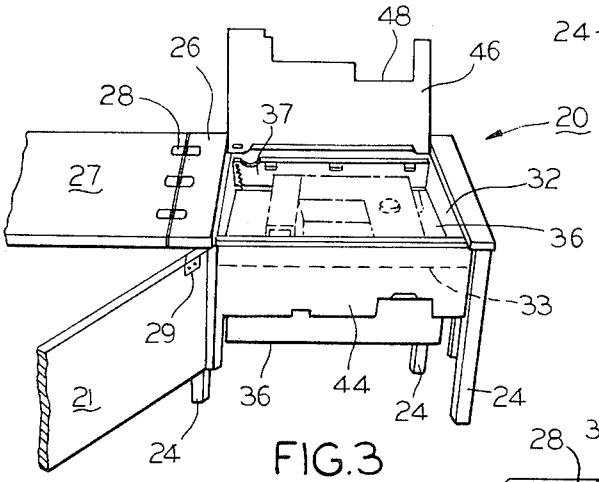
FIG. 3 is a similar view showing one of the steps in raising a sewing machine stored therein to operative position.
Figure 4:
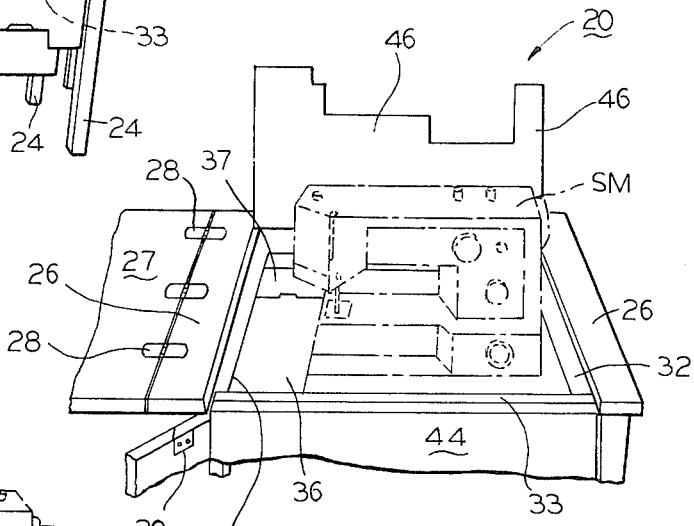
FIGS. 4 and 5 are similar views showing further steps.
Figure 5:
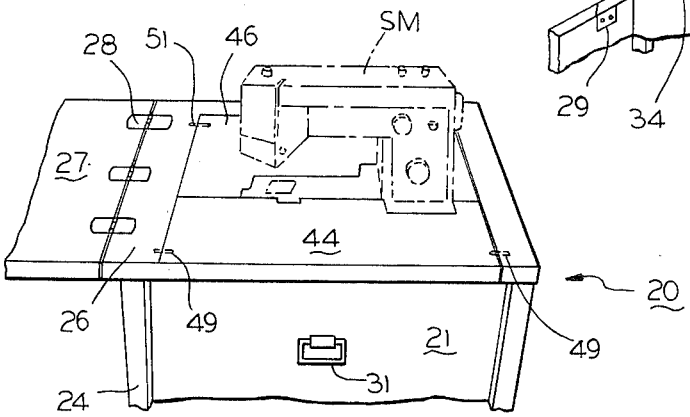
Figure 12:
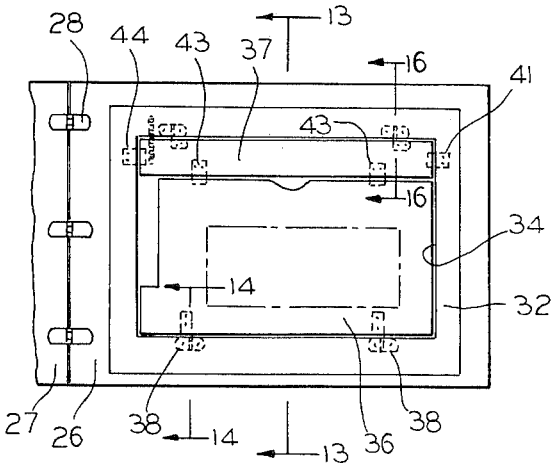
Figure 16:
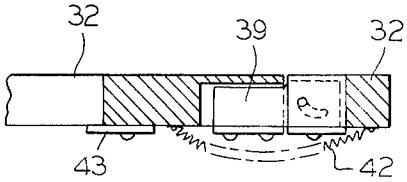
Figure 17:
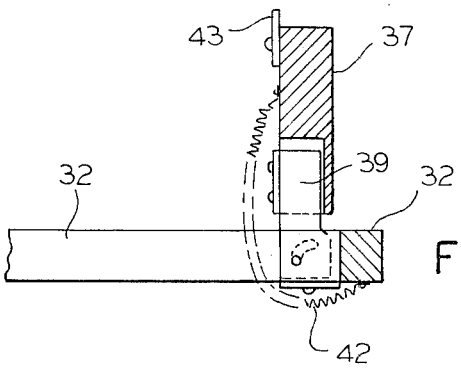
Figure 13:
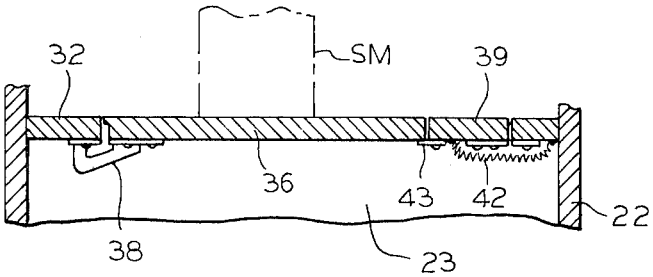
Figure 14:
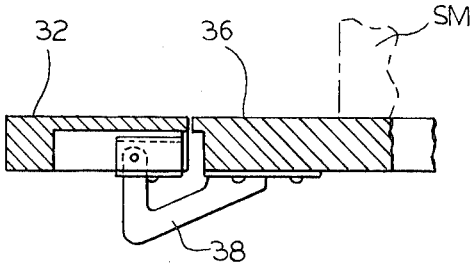
Figure 15:
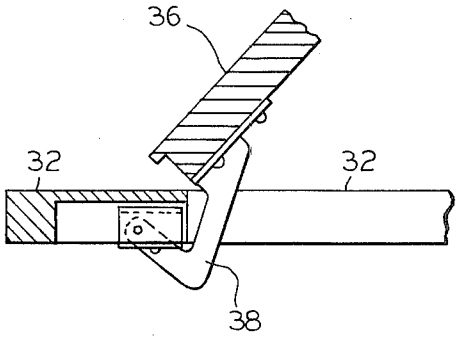

FIGS. 6 to 11 inclusive are transverse sectional views through the cabinet of FIG. 1 showing details of structure and steps in raising the machine to operative position;

FIG. 12 is a plan view similar to FIG. 2, but showing the machine in operative position for open arm sewing;

FIG. 13 is a sectional view taken along the line 13—13 of FIG. 12 looking in the direction of the arrows and showing details of structure for mounting the machine;

FIG. 14 is a sectional view taken along the line 14—14 of FIG. 12 showing details of hinge structure for the panel supporting the machine;

FIG. 15 is a view similar to FIG. 14 showing further details of the hinge structure;

FIG. 16 is a sectional view taken along the line 16—16 of FIG. 12 showing details of a hinge structure; and FIG. 17 is a similar view showing further details of the hinge structure seen in FIG. 16.

The improved sewing machine cabinet seen in FIGS. 1 to 5 is denoted generally by the reference numeral 20 and includes an enclosure for storing a sewing machine SM, such enclosure including a front wall 21, a back wall 22 (see FIGS. 6 to 11) and opposed side walls 23 (see again FIGS. 7 to 11). Cabinet 20 is mounted upon vertical legs 24, and the top of walls 22 and 23 and legs 24 are surmounted by a top 26 having a rectangular shaped opening 27 whereby top 26 is essentially U-shaped in plan view.

A closure panel 27 is held by hinges 28 by one side of U-shaped top 26, and is moved to the position seen in FIG. 1 to complete the appearance of cabinet 20 when storing a sewing machine therein. Front wall 21 is supported on hinges 29 to one of the front legs 24 for swinging movement, and wall 21 is provided with a pull 31 for such purpose.

Structure is provided for providing planar work surfaces for sewing machine SM stored within the cabinet thus far described. Such planar work surfaces are provided for the machine irrespective of whether it is employed for flat bed or open arm sewing.

To this end the walled enclosure has a lower panel 32 lying in an horizontal plane and secured to the inside of walls 22 and 23, one side of panel 32 being secured to a rail 33 extending between the front legs 24. Panel 32 has a rectangular shaped opening 34 for accommodating swinging movement of a first pair of panels 36 and 37 therein. Panel 36 has a sewing machine SM secured thereto in any convenient manner, and is secured for swinging movement in opening 34 upon knife hinges 38. In the storage position of machine SM panel 36 hangs pendantly.

Panel 37 is similarly mounted for swinging movement within rectangular opening 34 upon knife hinges 39. Panel 37 is normally biased to horizontal position against stops 41 located on the underside of panel 32 at opening 34 therein by a spring 42 connected between panel 37 and panel 32 and disposed beneath both.

Figure 8:
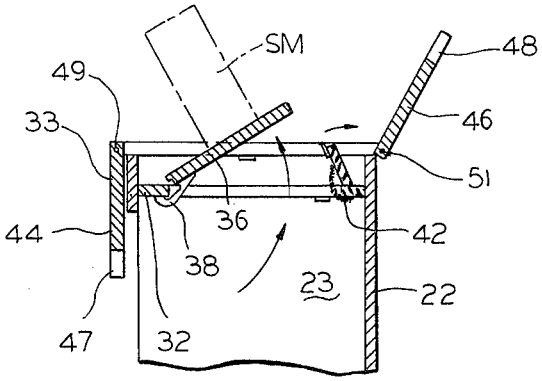
Figure 9:
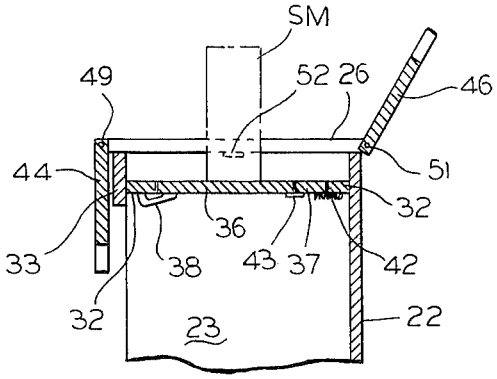

When it is desired to raise machine SM to position for open arm sewing, it is raised as seen in FIG. 8, panel 36 moving past panel 37, the latter pivoting as seen in FIG. 8 against the bias of spring 42. As seen in FIG. 9, panel 37 and machine SM are then moved in an opposite swinging direction to be held in position with reference to panel 37 by stops 43 protruding from the edge of panel 37. Together with stops 41 the two panels 36 and 37 are maintained in locked position for open arm sewing and are in planar relationship with panel 32 to define a work surface for the operator.

The structure for providing a work surface for flat bed sewing comprises a second pair of panels 44 and 46 overlying panels 36 and 37. Panels 44 and 46 have cut out portions 47 and 48 respectively for machine SM to protrude therethrough when in position. Panels 44 and 46 when in the planar position overlie panels 36 and 37.

Panel 44 is hingedly supported at its ends on pintles 49 supported in top 26 within opening 27 thereof, and panel 46 is likewise supported in pintles 51 also supported in opening 27.

Figure 6:
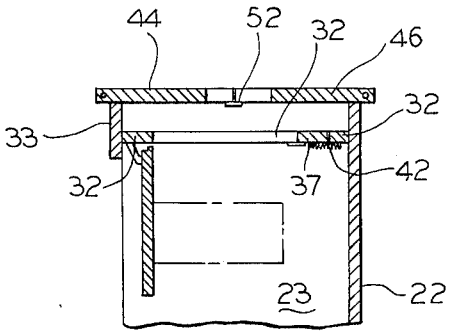
Figure 7:
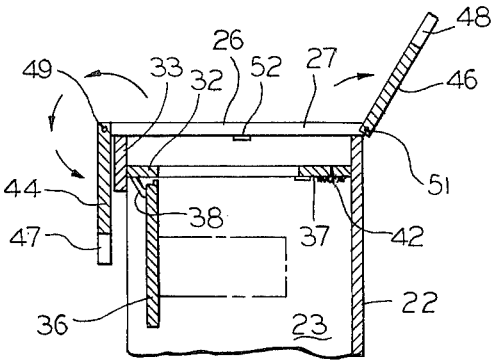

During storage of machine SM panel 44 is supported along its side edges on stops 52 as seen in FIGS. 6 and 7, and panel 46 is likewise supported along its side edges in opening 27 on stops 52.

Panels 44 and 46 and top 26 provide a planar surface for flat bed sewing by machine SM.

Figure 10:
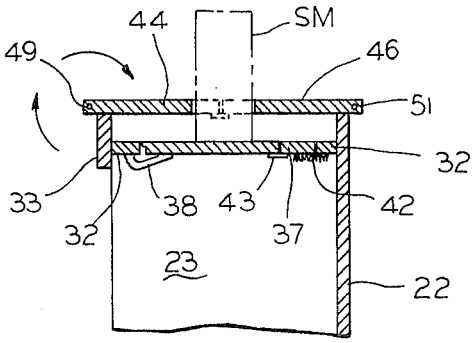
Figure 11:
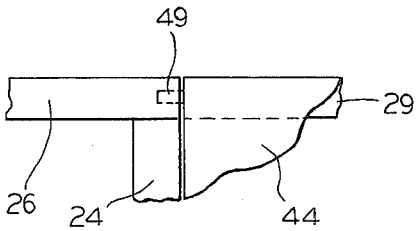

When it is desired to operate machine SM for open arm sewing, panels 44 and 46 are moved to position as seen in FIG. 9, panel 44 hanging pendantly against rail 33, and panel 46 being folded back. For flat bed sewing panels 44 and 46 are moved to position as seen in FIG. 10.

For storage of machine SM a reverse set of sequences takes place, preparatory to closing lid 27.

We claim:

1. In a cabinet for a sewing machine capable of open arm or flat bed sewing operations:

a. walls defining an enclosure for storage of a sewing machine;

b. first and second pairs of panels wholly pivotal within opposed walls of said enclosure and movable to positions selectively to provide work surfaces for open arm and flat bed sewing;

c. said first pair of panels supporting said machine for both flat bed and open arm sewing;

d. said second pair of panels overlying said first pair of panels and being movable into position over said first pair of panels into planar relationship to define a work surface for flat bed sewing;

e. one of said first pair of panels having said machine secured thereto and being hinged to the walls of said enclosure internally thereof for storage of said machine beneath the plane of said second pair of panels;

f. the second of said first pair of panels being hinged to walls of said enclosure in opposed relationship to said one panel of said first pair, and being swingable out of position by movement of the said one of said first pair of panels to the working position of said machine for both open arm and flat bed sewing;

g. meas biasing the said second of said first pair of panels to a position to support said machine after reverse swinging movement of the said one of said first panels.

2. The invention according to claim 1 wherein stop means are provided for holding said second of said first pair of panels in position when said one of said first pair of panels is moved in a reverse direction to a position for operation of said machine.

3. The invention according to claim 1 wherein said second of said first pair of panels is swingable against the bias of spring means during movement of the first of said first pair of panels and said machine to operative position.

4. The invention according to claim 3 wherein said second of said first pair of panels is moved by the bias of said spring means to stop means mounted within said enclosure to maintain both said one and said second of said first panels in position.

5. The invention according to claim 1 wherein said second pair of panels are provided with cutout portions whereby said machine protrudes above said second pair of panels when said machine is supported in position on said first pair of panels and is operable for flat bed sewing.

6. The invention according to claim 1 wherein said second named panels are swingable to a position for open arm sewing.

7. The invention according to claim 1 wherein said first and second pairs of panels are movable with respect to fixed panels having openings therein and wherein said pairs of panels are moved to coplanar position with respect to said fixed panels to define work surfaces for open arm and flat bed sewing.

8. In a cabinet for a sewing machine capable of open arm or flat bed sewing operations:

a. walls defining an enclosure for storage of a sewing machine;

b. first and second pairs of panels movable to positions selectively to provide work surfaces for open arm and flat bed sewing;

c. said first pair of panels supporting said machine for both flat bed and open arm sewing;

d. said second pair of panels overlying said first pair of panels and being movable into position over said first pair of panels into planar relationship to define a work surface for flat bed sewing by said machine;

e. one of said first pair of panels having said machine secured thereto and being hinged to said enclosure internally thereof for storage of said machine beneath the plane of said second panels;

f. the second of said first pair of panels being hinged to said enclosure in opposed relationship to said one panel, and being swingable out of position by movement of the said one of said first pair of panels to the working position of said machine for both open arm and flat bed sewing;

g. means biasing the said second of said first pair of panels to a position to support said machine after reverse swinging movement of the said first panels;

h. said last named means being spring means and said second of said first pair of panels being swingable against the bias of said spring means during movement of the first of said first pair of panels and said machine to operative position;

i. said second of said first pair of panels being moved by the bias of said spring means to stop means mounted within said enclosure to maintain both said one and said second of said first panels in position.

* * * * *